US007556429B2

(12) United States Patent
Taheri

(10) Patent No.: US 7,556,429 B2
(45) Date of Patent: Jul. 7, 2009

(54) RECLOSABLE MULTI-COMPARTMENT BAG WITH AN INTEGRATED POUCH

(75) Inventor: Nossi Taheri, Atlanta, GA (US)

(73) Assignee: The BagCo, Inc., Kennesaw, GA (US)

( * ) Notice: Subject to any disclaimer, the term of this patent is extended or adjusted under 35 U.S.C. 154(b) by 8 days.

(21) Appl. No.: 11/777,045

(22) Filed: Jul. 12, 2007

(65) Prior Publication Data

US 2008/0031554 A1 Feb. 7, 2008

Related U.S. Application Data

(62) Division of application No. 10/684,246, filed on Oct. 10, 2003, now abandoned.

(60) Provisional application No. 60/429,127, filed on Nov. 26, 2002.

(51) Int. Cl.
*B65D 30/22* (2006.01)
*B65D 33/16* (2006.01)

(52) U.S. Cl. ..... 383/38; 383/63

(58) Field of Classification Search ..... 383/38–40, 383/63

See application file for complete search history.

(56) References Cited

U.S. PATENT DOCUMENTS

| | | | | |
|---|---|---|---|---|
| 5,024,536 | A * | 6/1991 | Hill | 383/38 |
| 5,881,883 | A * | 3/1999 | Siegelman | 206/720 |
| 6,874,938 | B2 * | 4/2005 | Price et al. | 383/109 |
| 7,140,491 | B2 * | 11/2006 | Wang et al. | 206/484 |

* cited by examiner

*Primary Examiner*—Jes F Pascua
(74) *Attorney, Agent, or Firm*—Weatherly Kerven & Seigel LLC; Mitchell Weatherly; David Kerven

(57) ABSTRACT

A multi compartment reclosable plastic bag including four or more panels sealed together to form at least two bags with each bag having a resealable opening. One of the bags may be smaller than the other(s). The plastic bags further include lips that are adjacent to the resealable openings. The bags incorporate closure elements for sealing and unsealing of the resealable openings. The smaller bag may include a lip that folds toward the space between the smaller bag and an adjacent bag to form a cuff portion adapted to secure contents inserted between the smaller bag and the adjacent bag.

23 Claims, 9 Drawing Sheets

RECLOSABLE MULTI-COMPARTMENT BAG WITH AN INTEGRATED POUCH

I. CROSS REFERENCE TO RELATED APPLICATIONS

This application is a divisional application of U.S. patent application Ser. No. 10/684,246, filed Oct. 10, 2003 now abandoned, which claims the benefit of U.S. Provisional Patent Application Ser. No. 60/429,127 filed Nov. 26, 2002.

II. BACKGROUND OF THE INVENTION

The general principles for making reclosable plastic bags are fairly well known and are exemplified in many prior patents. Various developments in the reclosable plastic bags art, including methods to manufacture and various die assemblies used to manufacture such bags, are disclosed in U.S. Pat. No. 6,217,216 to Taheri (describes methods for forming bags), U.S. Pat. No. 4,755,248 to Geiger et al (die assemblies), U.S. Pat. No. 3,338,284 to Ausnit (forming a bag film web using a single extrusion operation), U.S. Pat. Nos. Re. 28,959, 29,208, and 28,969 to Nalto, U.S. Pat. No. Re. 33,674 to Uramoto, and U.S. Pat. No. Re. 26,991 to Luca (interlocking closure profiles), U.S. Pat. No. Re. 34,117 to Martin et al, U.S. Pat. No. 4,744,673 to Nakamura, U.S. Pat. No. 4,993,844 to Robinson et al (compartmented double zipper pouch), U.S. Pat. No. 5,102,234 to Levy (multi pocket bag for medical specimen), U.S. Pat. No. 5,353,041 to Fullerton et al, U.S. Pat. No. 6,234,675 to Saad et al (Multi compartment thermo plastic bag) and U.S. Pat. No. 5,024,536 to Hiu (resealable compartmented bags), all of which are incorporated here in their entirety for background information by these references. Although these patents disclose numerous fundamental methods for forming reclosable bags and reclosable closure elements, the present improvements are intended to be suitable with any of the known methods. It may be possible to use many fundamental methods to modify or adapt them, and to incorporate them into the invention disclosed below.

Reclosable plastic bags are used for many purposes, including transporting and storing food products or other materials. Reclosable plastic bags are often preferred over other available bags because of numerous advantages, including that they are easy to store and secure the contents when closed. Reclosable plastic bags are constructed with interlocking properties and are typically made with low-density polyethylene. Typically, consumers purchase various sizes of these bags to fit the need of each use. For example a standard 6×6 2-mil bag is used to pack a single sandwich. A 7×8 quart size is used to fit a sandwich accompanying another foodstuff such as a pickle or cookies. The larger sizes are used to store leftovers or larger objects.

III. SUMMARY OF THE INVENTION

A reclosable multi-compartment bag according to the invention includes at least two storage compartments, each with a resealable closure. Additionally, it offers an open pouch in between where other miscellaneous items can be put. Such a bag ensures that the two storage compartments stay adjacent each other at all times. Additionally, a bag according to the invention can be manufactured at a lower cost than the cost of manufacturing two bags separately and then joining them along their respective side and bottom edges. Furthermore, the multiple compartment bags can be sold in a single display box, which reduces packaging and shipping costs.

Briefly described, in a first embodiment, the present invention is comprised of two attached reclosable plastic bags. The reclosable plastic bag of the invention has many uses. One exemplary use of the bag is to store food in separate compartments. The present invention includes two reclosable bags each formed from two panels sealed along portions of their respective edges to form a container having a bottom and an openable top. Each reclosable bag also includes a closure element for opening and resealing the openable top of the bag. Each reclosable bag further includes lips that extend from the side of the closure opposite the interior of each bag. The two bags are attached by sealing all four panels of the two bags together, for example, along at least a portion of the bottom edge. The two bags may also be attached along additional portions of their respective side edges. The resealable bags are preferably of different heights so that the user can more easily grasp the lips of each bag and open each bag separately. However, the bags may be of equal height if desired. A pouch is formed between the front panel of the larger reclosable bag and back wall of the smaller reclosable bag. This pouch preferably does not contain a closure element like the two bags from which it is formed; however, a reclosable tape can be incorporated if so desired. Preferably the back lip of the front, smaller reclosable bag may be folded inward into the pouch to create a cuff inside the pouch, which can retain materials in the pouch if desired.

The manner in which the multi-compartment bag according to the invention provides advantages over conventional bags will be apparent from the following detailed descriptions of the exemplary embodiments and the appended drawings and claims. The foregoing general description and the following detailed description are exemplary and explanatory only and do not restrict the claims directed to the invention. The accompanying drawings, which are incorporated in and constitute a part of this specification, illustrate specific embodiments of the invention and together with the description, serve to explain further the principles of the invention.

IV. BRIEF DESCRIPTION OF THE DRAWINGS

As used herein, like numerals throughout the various figures represent the same or equivalent features of the invention.

V. DETAILED DESCRIPTION OF THE INVENTION

Figure 1:
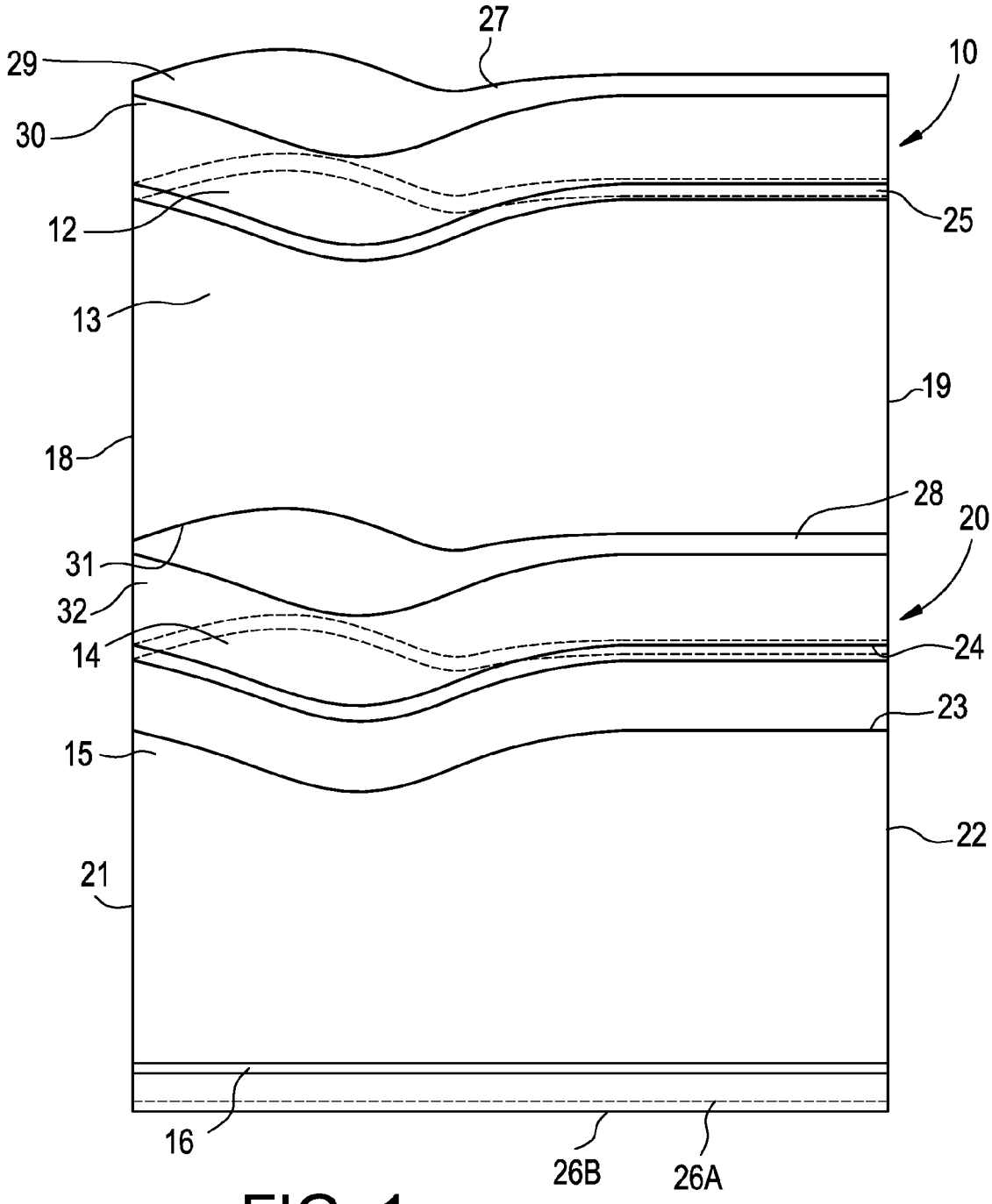
FIG. 1 is a front perspective view of one embodiment of a reclosable bag according to the invention.

This application refers in detail below to some exemplary embodiments of the reclosable bag with integrated pouch according to the invention, which are illustrated in the accompanying drawings. The same reference numerals are often used throughout the drawings to refer to the same or similar items.

The invention is directed to multi-compartment containers and in particular to plastic bags having separately resealable compartments. Bags according to the invention have numerous advantages. For example such a bag can contain, in separate compartments, liquids or aggregate materials of different types that a user wishes to keep together. The bags also permit a user to contain materials in predetermined quantities. A first embodiment of the invention comprises two reclosable bags 10 and 20, as shown for instance in FIG. 1, and includes first panel 12 and second panel 13 for reclosable bag 10 and first panel 14 and second panel 15 for reclosable bag 20.

The bags 10 and 20 preferably are made from plastic or other flexible materials such as low-density polyethylene (LDPE), linear low-density polyethylene (LLDP), or a combination of various other thermoplastic materials. However, it is possible to construct bags of materials that are microwave safe if desired. While the panels 12-15 of bags 10 and 20 may be of various thicknesses, a preferred thickness for the panels is about 1.5 to 2.0 mils when the bag is meant for use as a storage bag and about 2.2 to 2.5 mils when the bag is meant for use as freezer bag. Still referring to FIG. 1, panels 12 and 13 of bag 10 are sealed together near the bottom edge 26A and along side edges 18 and 19 to define a first container having an interior capable of receiving and storing contents. The bag 10 further incorporates a resealable opening 27, closure element 25, and first and second lips 29 and 30. The lips 29 and 30 of bag 10 extend above the closure element 25 to facilitate easy opening of the bag 10. Alternatively, lip 29 may extend further above closure 25 than lip 30 to facilitate further easy opening of closure 25.

Panels 14 and 15 of bag 20 are sealed together near the bottom edge 26B and along side edges of 21 and 22 to define a second container having an interior capable of receiving and storing contents. The bag 20 further includes a resealable opening 28, closure element 24, and first and second lips 31 and 32. The lips 31 and 32 of bag 20 extend above closure element 24 to facilitate easy opening of the bag 20. Optionally, lip 31 of bag 20 may be substantially longer than lip 32 and folded backward in a cuff manner behind the bag 20 to define edge 23 (FIG. 1). To facilitate easier opening and closing of the closure elements 24 and 25, the lips of both bags 10 and 20 preferably extend more than one half of an inch above the closure elements 24 and 25 respectively. During manufacture of bags 10 and 20, their respective side edges 18, 19 and 21, 22, are typically sealed along their entire lengths from openable tops 27 and 28 to bottom edges 26A and 26B.

Figure 2:
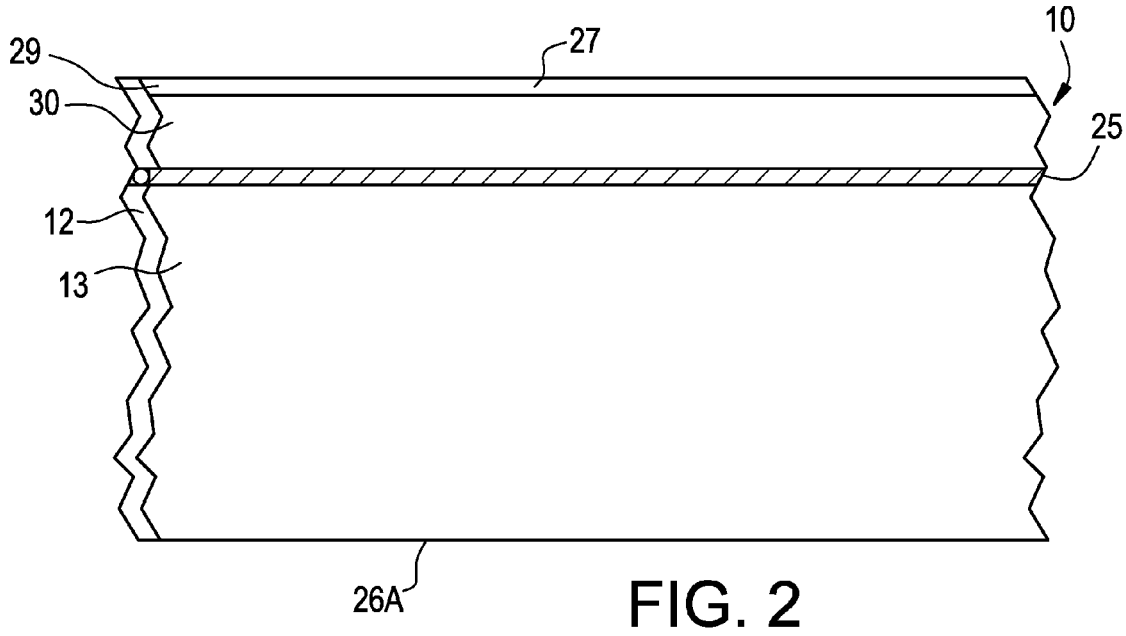
FIG. 2 is a fragmentary front view of a portion of the bag of FIG. 1 including a closure element according to one aspect of the invention.
Figure 3:
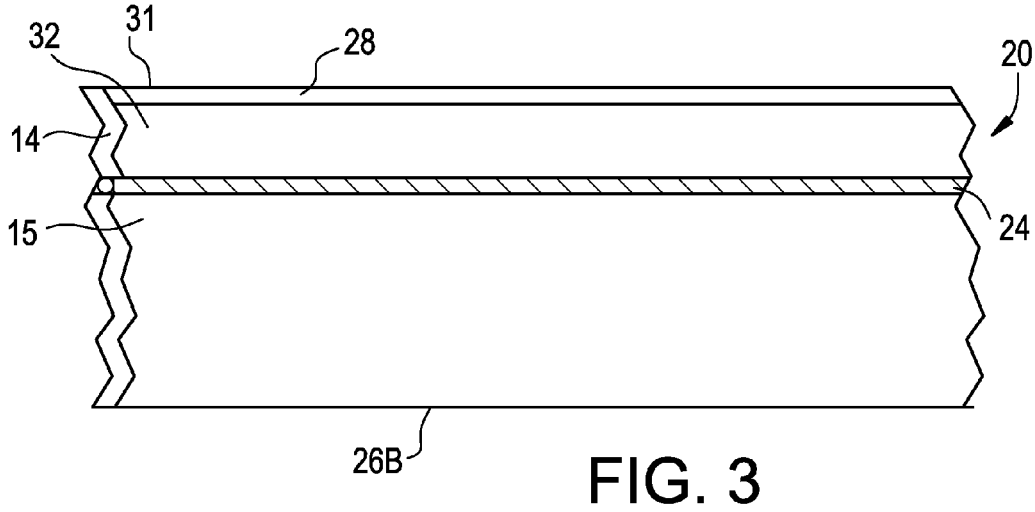
FIG. 3 is a fragmentary front view of another portion of the bag of FIG. 1 including a closure element according to one aspect of the invention.
Figure 4:
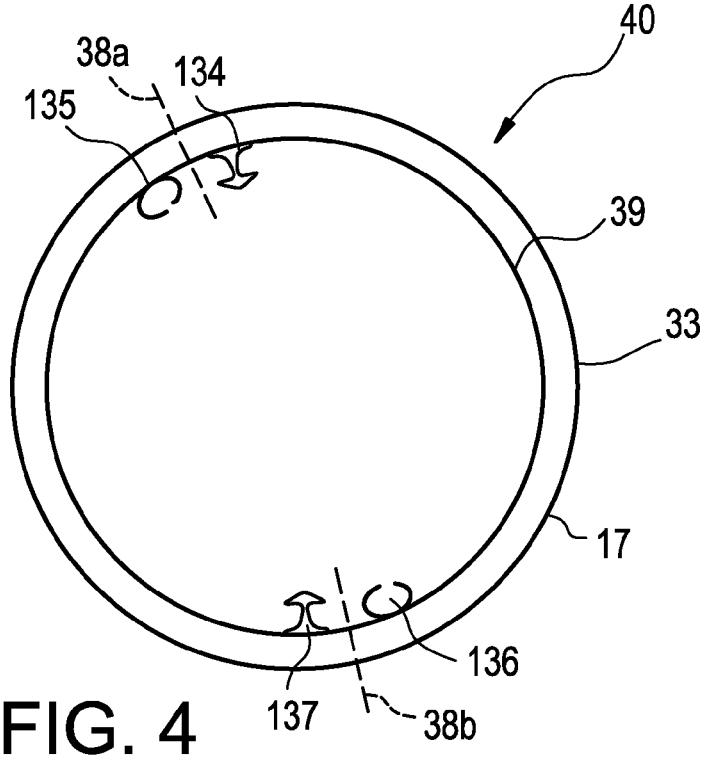
FIG. 4 is a cross sectional front view of an extruding die configured to extrude a single tubular film of material having two closures that is suitable for making a bag according to the invention or two tubes of material with each having one closure that are suitable for making a bag according to the invention.
Figure 5:
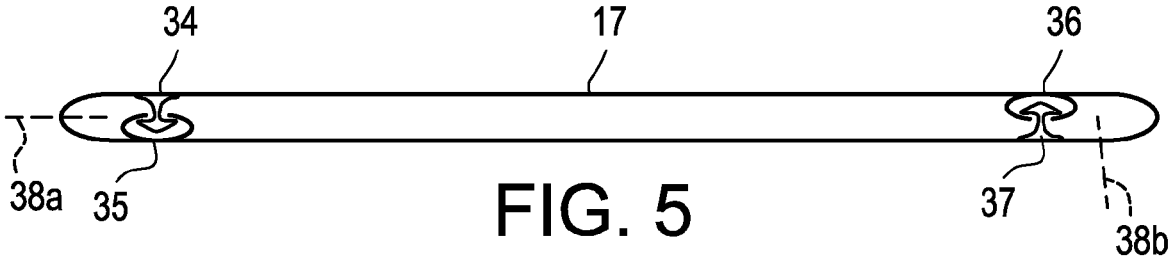
FIG. 5 is an end view of an intermediate structure of a tube extruded from the die shown in FIG. 4 in the single tube configuration that is suitable for making a bag according to the invention and in which the closure elements have been mated but the tube has not yet been longitudinally cut to define the lip portions of the bag.
Figure 6:
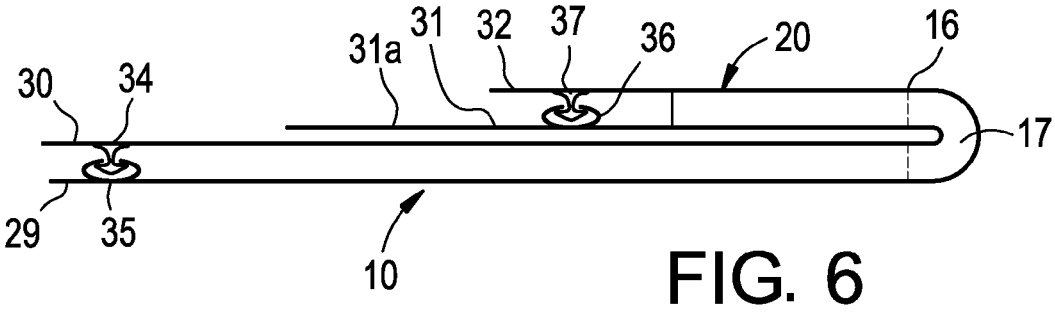
FIG. 6 is an end view of the structure shown in FIG. 5 after the tube has been (1) cut longitudinally to define lip portions of the bag and (2) folded to define first and second bag portions, but before the tube has been (1) sealed longitudinally near the fold to define the bottom of the bag and (2) transversely cut and sealed to define the sides of the bag.
Figure 7:
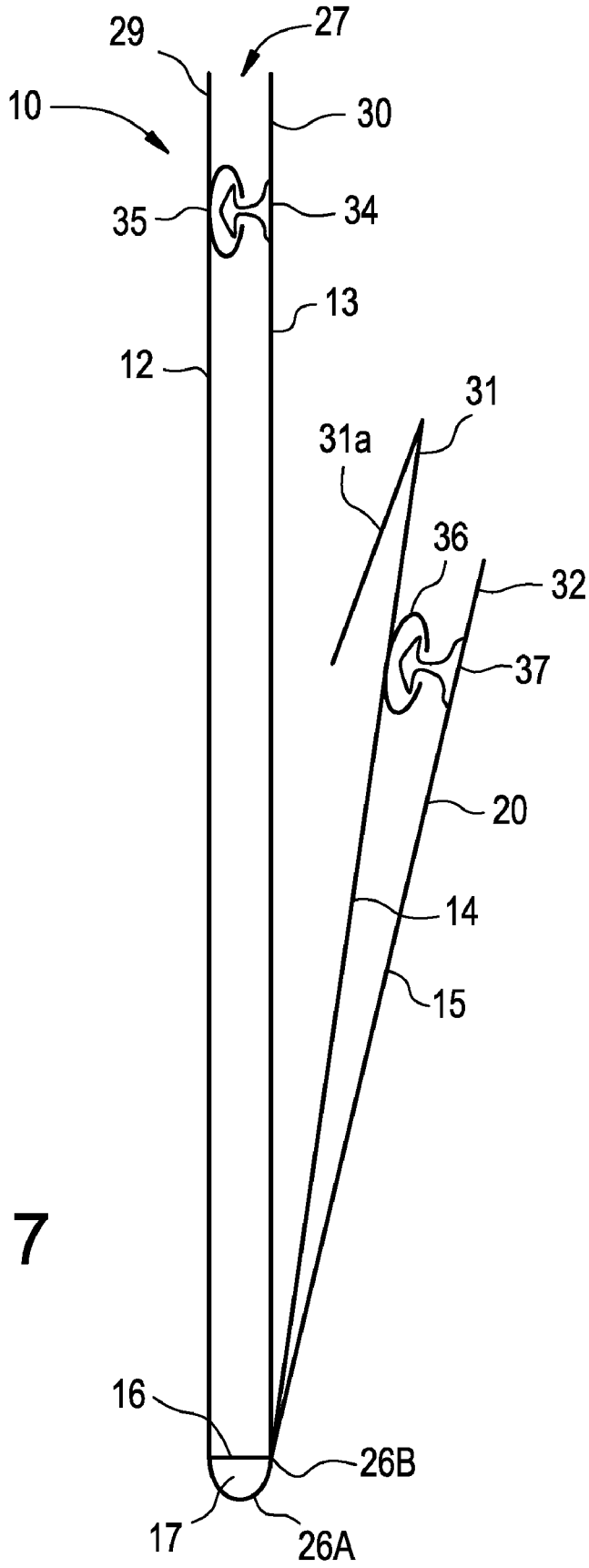
FIG. 7 is an end view of an intermediate structure of two tubes of film before the tubes are transversely cut and sealed to define the sides of a bag according to the invention.
Figure 8:
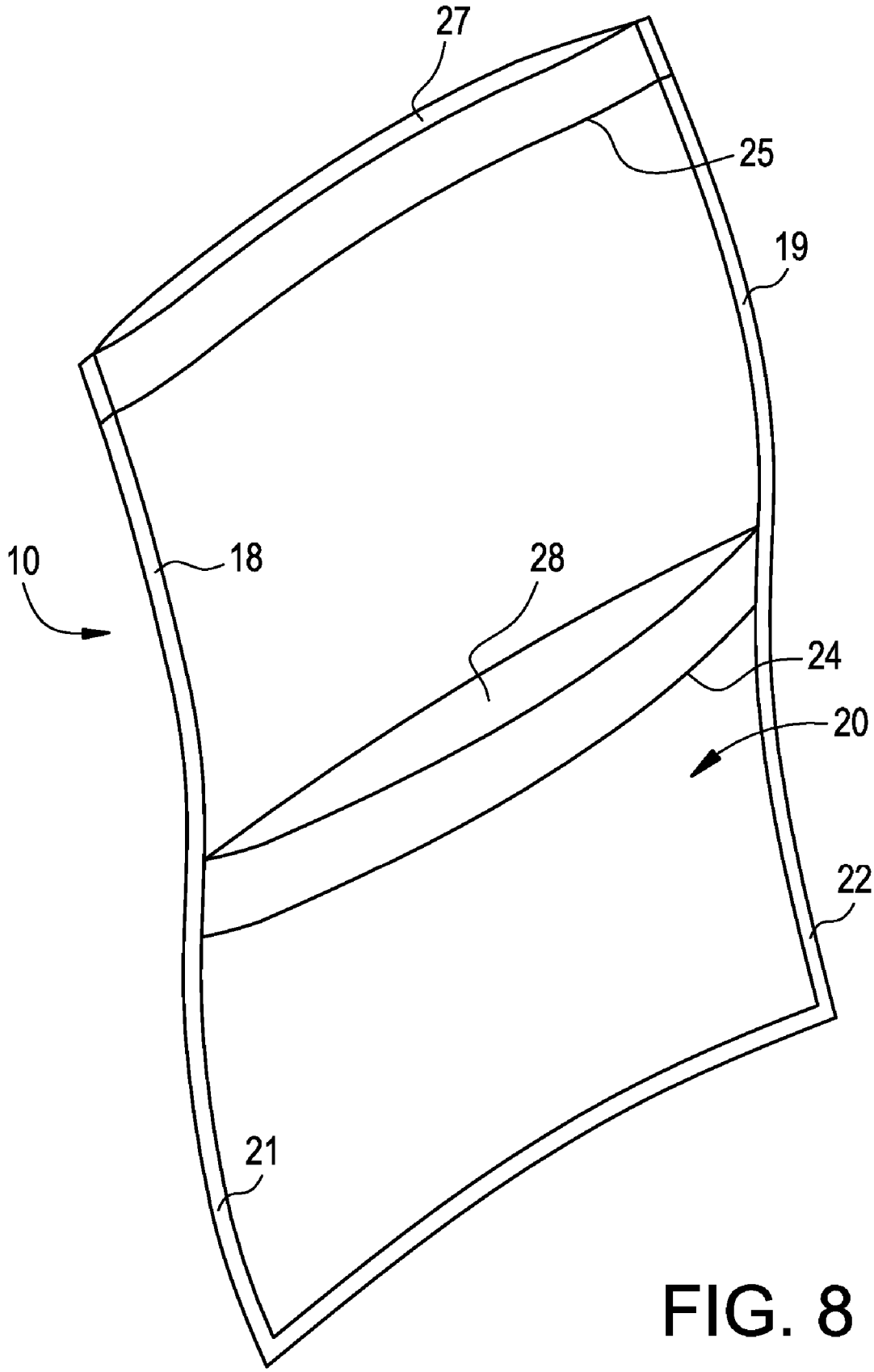
FIG. 8 is perspective view of another embodiment of a bag according to the invention in which the bottom and both sides of the bag are sealed with a relatively wide heat seam.

Bags according to the invention may be manufactured according to the following steps. The bags 10 and 20 may be made from either two separate reclosable filmstrips as shown in FIGS. 2 and 3 (method A) or one single reclosable filmstrip as shown in FIGS. 4-6 (method B). There are economic advantages and disadvantages to method A and method B. For example, method A permits the use of different materials and thicknesses in each of the film strips. Additionally, method A permits the filmstrip in FIG. 2 to be wider than the filmstrip shown in FIG. 3. After each filmstrip is extruded, it is folded along a longitudinal axis to form a front and back panel of a bag with a bottom edge (e.g., bag 10 with panels 12 and 13 and bottom edge 26A and bag 20 with panels 14 and 15 and bottom edge 26B). One filmstrip is laid upon the other and positioned so that the bottom edges 26A and 26B substantially coincide to achieve and even bottom seal. After the extrusion step, each of the filmstrips may be optionally wound onto a spool to permit the extrusion and bag formation steps to be performed at significantly later times or in a separate location. Although this alignment is not essential, it will affect the current interior dimensions of the bag that is predetermined before the manufacturing. Each of the two folded filmstrips shown in FIG. 2 and FIG. 3 are cut and sealed along their side edges 18, 19 and 21, 22 to form bags 10 and 20 respectively of desired width dimensions (as shown in FIG. 1). If the cutting operation is carried out with bags 10 and 20 overlapping, the operation will also attach bag 10 to bag 20 along their respective side edges 18, 19 and 21, 22. Bags 10 and 20 are also attached using a relatively wide heat seam shown as seal 16 in FIG. 1 (and optionally along their respective side edges 18, 19 and 21, 22 as shown in FIG. 8). To ensure that both bags 10 and 20 are sealed near their respective bottom edges 26A and 26B, seal 16 may be located about ¼" to ½" from bottom edges 26A and 26B. However, seal 16 can be located as close to the bottom edges 26A and 26B as the dimensional tolerances of the manufacturing process permit. Additionally, the natural pouch created between resealable bags 10 and 20 may be used to contain a third type of material. To retain more securely the contents in the space between bags 10 and 20, bag 20 may also include an extended lip 31 that defines cuff 31*a* that is folded into the space between bag 10 and bag 20 as shown, for example, in FIG. 7. As an alternative embodiment (not illustrated), the pouch with a cuff 31*a* can be formed between panel 13 of bag 10 and only one panel 14 without a panel 15 to form a bag 20. In such an embodiment, only bag 10 is resealable with a zipper-like closure element, and the pouch between panel 14 and panel 13 can be used as described above.

FIGS. 4-6 illustrate method B in which a multi-compartment bag according to the invention is made from a single extruded filmstrip. In method B, the film is extruded through a die 40 as shown, for example, in FIG. 4. The male closure profiles 34 and 37 and the female closure profiles 35 and 36 are extruded through elements 134 and 137 and 135 and 136 of die 40 respectively as illustrated in FIG. 4. Suitable material is extruded through the space defined between wall 33 and wall 39 of die 40 with die elements 134/135 and 136/137 configured to form a film with two male/female pairs of closure elements 34/35 and 36/37 respectively. After the material is extruded, it may be flattened into the tubular shape illustrated in FIG. 5. Once flattened as shown, male profile 34 and female profile 35 of closure element 24 are positioned to mate with one another, and male profile 37 and female profile 36 of closure element 25 are positioned to mate with one another. Before the flattened tube is formed into bags 10 and 20, the male profile is engaged with female closure profile 35 and male closure profile 37 is engaged with female closure profile 36. The looped material on the ends of the tube shown in FIG. 5 is cut at positions 38*a* and 38*b* to form lip pairs 29-30 of bag 10 and 31-32 of bag 20. FIG. 6 illustrates that the cut tubular film of FIG. 5 is folded at designated location 17 so that bags 10 and 20 overlap. After the film is folded, bags 10 and 20 are formed as separate containers by heat sealing panels 12-15 of the folded film portions to each other near location 17 to form seal 16, for example, by heat sealing or ultrasonic welding among other methods. Optionally, lip 31 can be folded inwardly to form the cuff portion 31*a* in the space between bags 10 and 20. After seal 16 is formed, the film is a continuous tube of material with separately resealable bag portions 10 and 20. The last manufacturing step to transform this tube into separate multi-compartment bags is simultaneously cutting and sealing the tube in a direction perpendicular to the longitudinal axis of the tube to define side edges 18, 19, 21, and 22 of the multi-compartment bag.

The height of bags 10 and 20 of the multi-compartment bag according to the invention can be varied by moving the closure profiles 34-37 around the perimeter of die 40. Alternatively, the height of bags 10 and 20 made with die 40 as shown in FIG. 4 can be altered from that which is described above by mating male closure profile 34 with female closure profile 36 and mating male closure profile 35 with female closure profile 37. In this mating arrangement, cutting the tube extruded from die 40 at 38*a* and 38*b* results in two separate bags being formed without any further sealing. These bags 10 and 20 could be attached to each other by laying one upon the other and sealing them to each other as described above in connection with method A.

FIG. 8 illustrates another embodiment of the bag in which the seals along the bottom and side edges are formed as wide heat seams. The use of wide heat seams further permits a multi-compartment bag according to the invention to be made from four separate films rather than the two films of method A and the one film of method B described above. The wider the heat seams, the stronger and more leak resistant they become.

Figure 9:
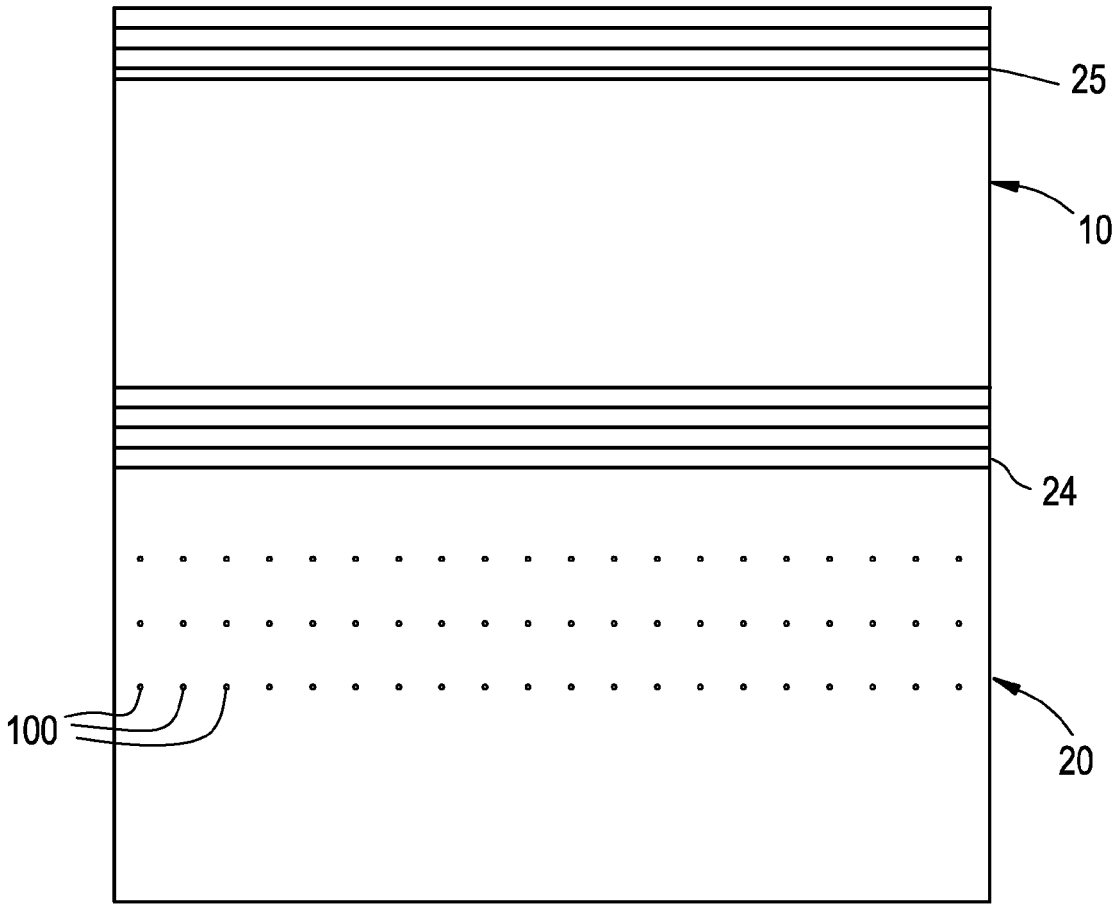
FIG. 9 is a plan view of a bag according to the invention with small perforations in one of the panels.

As shown in FIG. 9, the multi-compartment bag may be also used to store and carry food as a lunch bag. In order to keep the prepared food fresh for later use, it may be desirable to store condiments in different pouch from the other food for later application to that other food to complete the preparation. As an example, a sandwich prepared with cold cuts and meats may contain tomato or pickle etc. Once these items are combined, the sandwich should be consumed momentarily. Otherwise, the juices from the condiments or vegetables may make the sandwich soggy or otherwise unappealing if the condiments or vegetables are placed on the sandwich too early. Some items, like lettuce, remain fresher and more appealing if stored in a bag that permits airflow. Therefore, the multi-compartment bag according to the invention may optionally include perforations 100 in one or more of panels 12-15 to accommodate such items.

Figure 10:
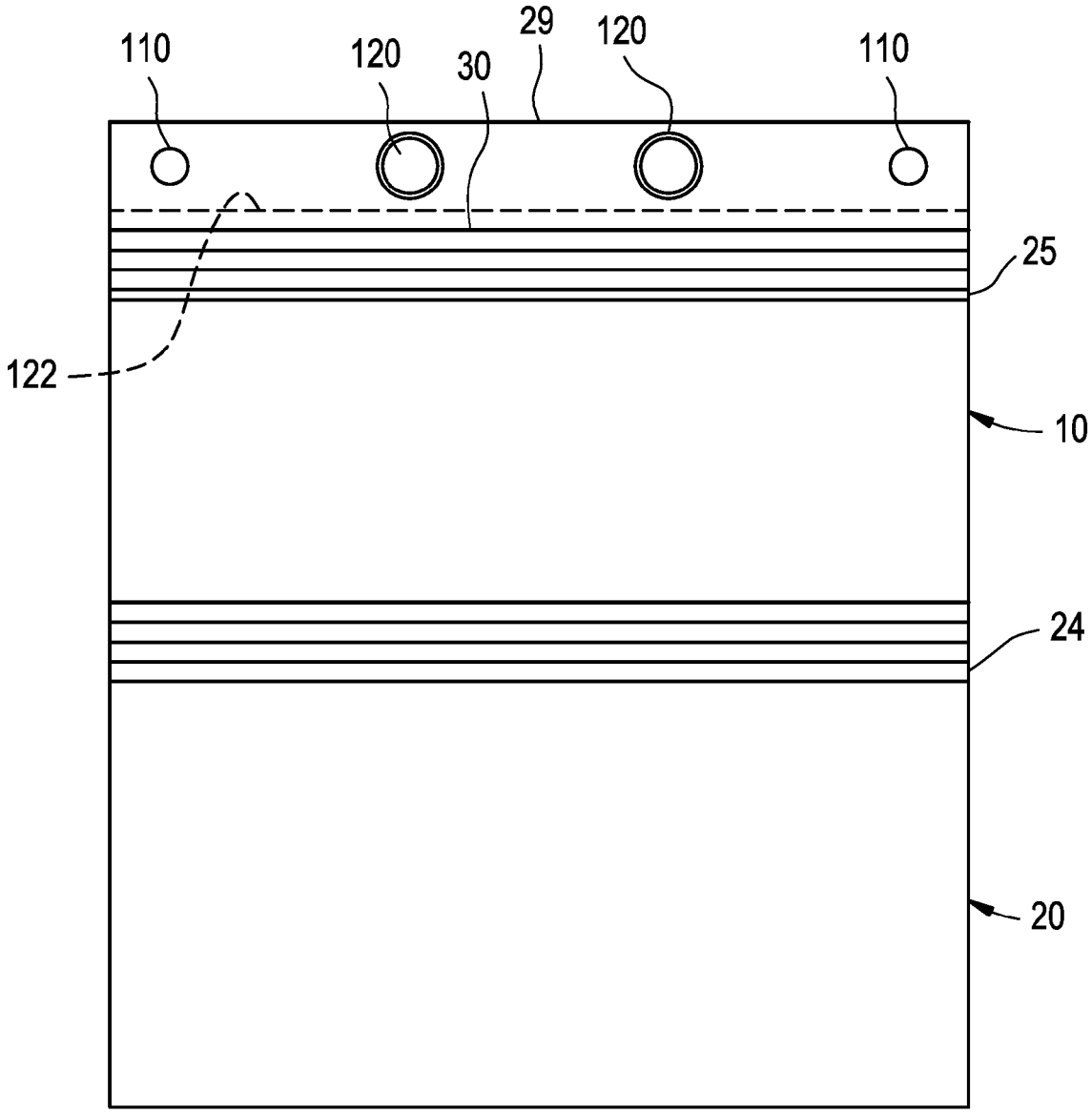
FIG. 10 is schematic plan view of a plurality of bags according to the invention that have been wicketted for display and dispensing purposes.

As shown in FIG. 10, several multi-compartment bags may be stacked and sealed together at designated points so that each bag in the stack can be removed individually. Arranging bags in this fashion is called wicketting bags. This wicketted multi-compartment bag is particularly adapted for use, for example, at a delicatessen section of supermarket. The larger bag 10 may have a longer back lip 29 with two wicket holes 120 with centers approximately 3" apart. The wicket holes 120 are used to install the bag on a wicket saddle (not shown). In order to use this bag, a small quantity of the bags are sealed together, for example, at two locations 110 near each side of the bag by running a hot melt sealer through the back lip 29 of each bag in the stack of bags. Each bag can be separated from the display by lifting the bag and tearing it along the perforation line 122 on the back lip 29 located below the wicket holes 120.

Figure 11:
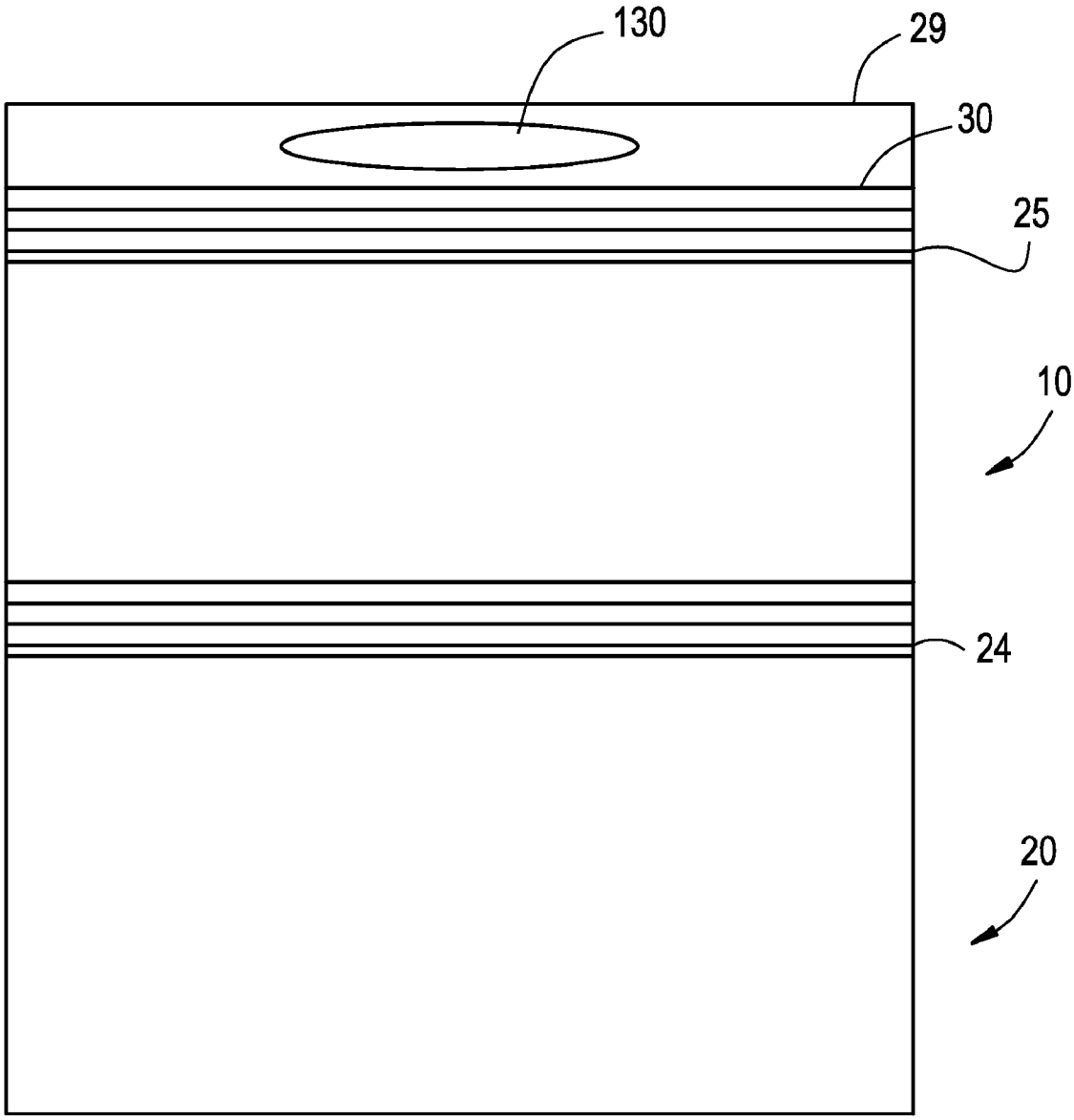
FIG. 11 is a plan view of a bag according to the invention including an integrated carrying handle.

As shown in FIG. 11, a reclosable bag according to the invention may be adapted to serve as a carry bag with an integrated carrying handle. Such a bag includes a back lip 29 that extends farther from closure 25 than front lip 30 to leave space for aperture 130, which can serve as a handle. Alternatively, aperture 130 can be formed in two relatively long lips 29 and 30.

Figure 12:
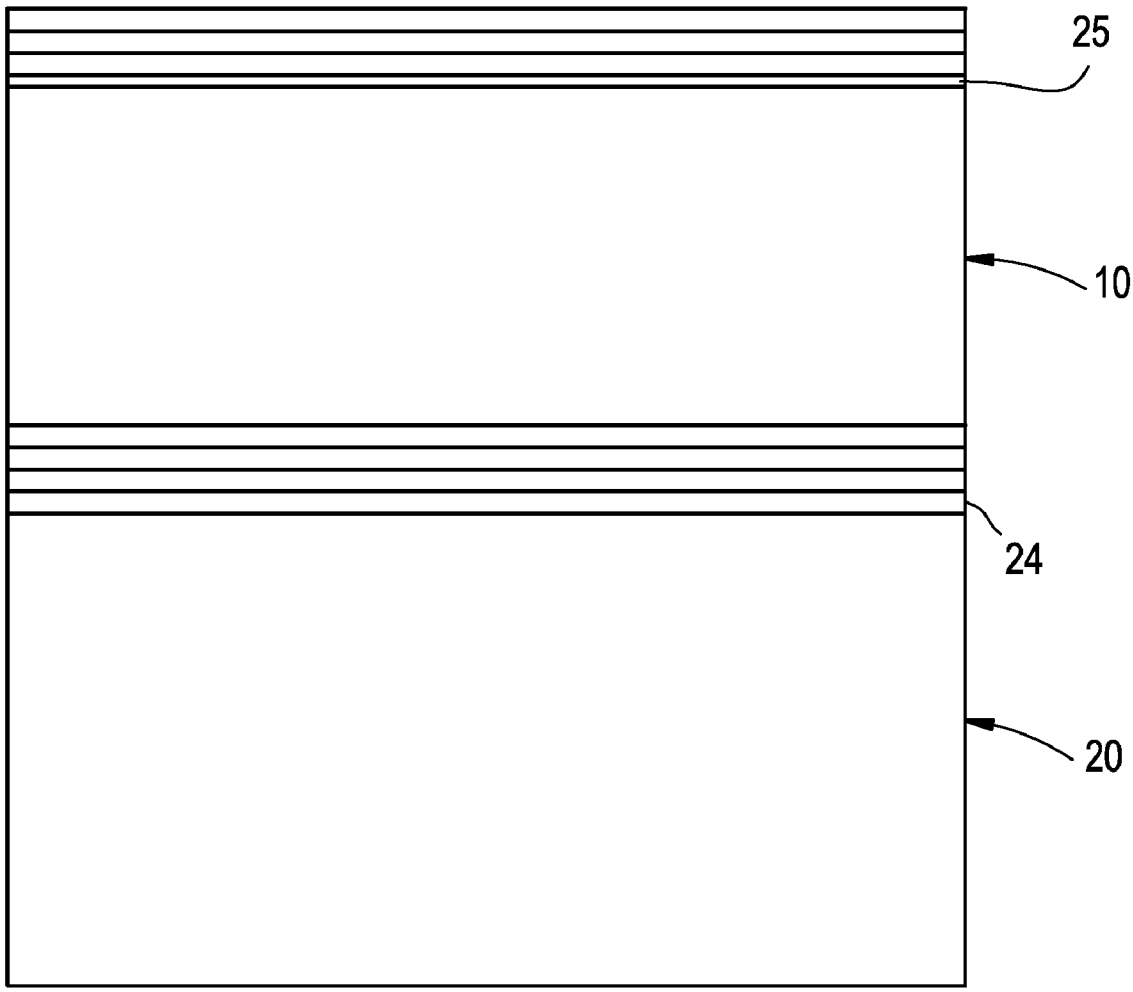
FIG. 12 is a plan view of a bag according to the invention illustrating the manner in which various portions of the bag may be tinted or colored to achieve certain advantages.

As shown in FIG. 12, in another embodiment of a bag according to the invention, bag 10 is tinted one color and bag 20 is tinted a different color. For example, in FIG. 12, the bag 10 is tinted blue and the bag 20 is tinted yellow. The closures 24 and 25 can be tinted with coordinating or contrasting colors to assist a user in distinguishing the closures from the bags and determining whether the closures are sealed. Alternatively, the closures 24 and 25 may be provided without coloration. Because the bags 10 and 20 are differently colored, users are alerted to the fact that there are two separate bags integrated together.

While certain embodiments are described above with particularity, these should not be construed as limitations on the scope of the invention. It should be understood, therefore, that the foregoing detailed description relates only to exemplary embodiments of the invention, and that numerous changes may be made without departing from the spirit and scope of the invention, which is defined by the following claims.

What is claimed is:

1. A multi-compartment bag, comprising:

A. a first resealable bag comprising:

i. a first panel, ii. a second panel that is connected to the first panel along at least portions of the bottom edges and side edges of the first and second panels to define a first opening to a first container, iii. a first closure element that is positioned near the first opening, comprising:

a. a first female portion that is disposed on a first inner surface of the first panel with a first lip portion on the first panel extending proximally from the first female portion and b. a first male portion that is:

(1) complementary to the first female portion and (2) disposed on a second inner surface of the second panel with a second lip portion on the second panel extending proximally from the first male portion; and B. a second resealable bag that is connected to the first resealable bag, comprising:

i. a third panel, ii. a fourth panel connected to the third panel along at least portions of the bottom edges and side edges of the third and fourth panels to form a second opening to a second container, and iii. a second closure element positioned near the second opening, comprising:

a. a second female portion that is disposed on a third inner surface of the third panel with a third lip portion on the third panel extending proximally from the second female portion, and b. a second male portion that is:

(1) complementary to the second female portion and (2) disposed on a fourth inner surface of the fourth panel with a fourth lip portion on the fourth panel extending proximally from the second male portion;

in which:

the second resealable bag is connected to the first resealable bag along at least portions of the bottom edges and side edges of the first and second resealable bags to form a third opening to a third container between the first resealable bag and the second resealable bag, the third lip portion extends proximally farther from the second female portion than the fourth lip portion extends proximally from the second male portion, and the third lip portion is folded into the space between the second panel and the third panel to form a cuff inside the third container.

2. The multi-compartment bag of claim 1, further comprising a plurality of first perforations in the first panel.

3. The multi-compartment bag of claim 2, further comprising a plurality of second perforations in the second panel.

4. The multi-compartment bag of claim 1, further comprising a plurality of second perforations in the second panel.

5. The multi-compartment bag of claim 1, further comprising a plurality of third perforations in the third panel.

6. The multi-compartment bag of claim 1, further comprising a plurality of fourth perforations in the fourth panel.

7. The multi-compartment bag of claim 6, further comprising a plurality of third perforations in the third panel.

8. The multi-compartment bag of claim 7, further comprising an aperture in the first and second lip portions to form a handle.

9. The multi-compartment bag of claim 1, in which at least a portion of the first panel is tinted with a first color.

10. The multi-compartment bag of claim 9, in which the at least a portion of second panel is tinted with a second color different from the first color.

11. The multi-compartment bag of claim 1, in which at least a portion of the second panel is tinted with a second color.

12. The multi-compartment bag of claim 1, in which at least a portion of the third panel is tinted with a third color.

13. The multi-compartment bag of claim 1, in which at least a portion of the fourth panel is tinted with a fourth color.

14. The multi-compartment bag of claim 13, in which at least a portion of the third panel is tinted with a third color that is different from the fourth color.

15. The multi-compartment bag of claim 1, in which at least a portion of the first male portion is tinted with a first color.

16. The multi-compartment bag of claim 15, in which at least a portion of the first female portion is tinted with a second color different from the first color.

17. The multi-compartment bag of claim 1, in which at least a portion of the first female portion is tinted with a second color.

18. The multi-compartment bag of claim 1, in which at least a portion of the second male portion is tinted with a third color.

19. The multi-compartment bag of claim 1, in which at least a portion of the second female portion is tinted with a fourth color.

20. The multi-compartment bag of claim 19, in which at least a portion of the second male portion is tinted with a third color that is different from the fourth color.

21. The multi-compartment bag of claim 1, in which the second resealable bag is connected to the first resealable bag along at least portions of their respective bottom edges using a wide heat seam.

22. The multi-compartment bag of claim 21, in which the wide heat seam is positioned at a location from about one quarter of an inch to one half of an inch from the bottom edges of the first and second resealable bags.

23. The multi-compartment bag of claim 21, in which the wide heat seam is further applied along at least portions of the respective side edges of the first and second resealable bags.

* * * * *